US007661984B2

(12) United States Patent
McMullen et al.

(10) Patent No.: US 7,661,984 B2
(45) Date of Patent: Feb. 16, 2010

(54) LOCKING THREADED CONNECTION COAXIAL CONNECTOR

(75) Inventors: Norman S McMullen, Frankfort, IL (US); Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 0 days.

(21) Appl. No.: 12/349,905

(22) Filed: Jan. 7, 2009

(65) Prior Publication Data

US 2009/0186521 A1 Jul. 23, 2009

Related U.S. Application Data

(60) Provisional application No. 61/022,808, filed on Jan. 22, 2008.

(51) Int. Cl.
*H01R 9/05* (2006.01)

(52) U.S. Cl. ..... 439/583

(58) Field of Classification Search ..... 439/583, 439/584, 578

See application file for complete search history.

(56) References Cited

U.S. PATENT DOCUMENTS

| | | | | |
|---|---|---|---|---|
| 4,046,451 | A * | 9/1977 | Juds et al. | 439/583 |
| 4,585,289 | A | 4/1986 | Bocher | |
| 5,352,127 | A | 10/1994 | Muller et al. | |
| 5,795,188 | A | 8/1998 | Harwath | |
| 5,938,474 | A | 8/1999 | Nelson | |
| 6,109,964 | A | 8/2000 | Kooiman | |
| 6,133,532 | A * | 10/2000 | Lundback et al. | 174/88 C |
| 6,267,621 | B1 | 7/2001 | Pitschi et al. | |
| 6,386,915 | B1 | 5/2002 | Nelson | |
| 6,607,398 | B2 | 8/2003 | Henningsen | |
| 6,793,529 | B1 | 9/2004 | Buenz | |
| 7,077,700 | B2 | 7/2006 | Henningsen | |
| 7,347,729 | B2 * | 3/2008 | Thomas et al. | 439/583 |
| 2005/0079761 | A1 * | 4/2005 | Rodrigues | 439/578 |
| 2009/0149064 | A1 * | 6/2009 | Schuster et al. | 439/578 |

* cited by examiner

*Primary Examiner*—Gary F. Paumen
(74) *Attorney, Agent, or Firm*—Babcock IP, PLLC

(57) ABSTRACT

A coaxial connector includes a clamp nut dimensioned to fit over the outer conductor, the clamp nut having threads that mate with corresponding threads on the connector body. A clamp element is positioned between the clamp nut and a leading edge of the outer conductor. The connector body having an annular wedge surface dimensioned to mate with the leading edge of the outer conductor. The threads draw the clamp nut towards the connector body, to clamp the leading edge between the clamp element and the annular wedge surface. A surface-to-surface positive stop between the clamp nut and the connector body limits the compression force to a predetermined maximum by preventing further movement of the clamp nut towards the connector body. A thread lock is engaged as the positive stop is reached; the thread lock inhibiting unthreading of the clamp nut from the connector body.

20 Claims, 8 Drawing Sheets

LOCKING THREADED CONNECTION COAXIAL CONNECTOR

CROSS REFERENCE TO RELATED APPLICATIONS

This application claims the benefit of U.S. Provisional Patent Application No. 61/022,808, "LOCKING THREADED CONNECTION COAXIAL CONNECTOR", by Norman S. McMullen, filed Jan. 22, 2008—currently pending and hereby incorporated by reference in the entirety.

BACKGROUND

1. Field of the Invention

This invention relates to electrical cable connectors. More particularly, the invention relates to a coaxial cable connector having a locking threaded connection for the prevention of undesired loosening of the threaded connection after assembly.

2. Description of Related Art

Coaxial cable connectors are used, for example, in communication systems requiring a high level of reliability and precision.

To create a secure mechanical and optimized electrical interconnection between the cable and the connector, it is desirable to have uniform, circumferential contact between a leading edge of the coaxial cable outer conductor and the connector body. A flared end of the outer conductor may be clamped against an annular wedge surface of the connector body, using a coupling nut. Representative of this technology is commonly owned U.S. Pat. No. 5,795,188 issued Aug. 18, 1998 to Harwath.

To minimize twisting forces upon the outer conductor as the coupling nut is tightened, an opposing thrust collar may be placed between the back side of the flared end of the outer conductor and the coupling nut. To allow the wedge ring to fit over the flared end of the outer conductor, a circular coil spring or the like may be used between the thrust collar and the flared end of the outer conductor. Rotation of the coupling nut urges the thrust collar, if present, against the spring and the spring against the backside of the flared end of the outer conductor. Thereby, the flared end of the outer conductor is securely sandwiched between the annular wedge surface and the spring.

A connector that is poorly installed may damage equipment, significantly degrade system performance and/or lead to premature system failure. Therefore, prior connectors typically include extensive installation instructions that require costly specialized tools.

Threaded connections on and between connectors are typically tightened using wrenches having the potential for large moment arm force generation that may damage the connector and/or associated cable(s). Commonly owned U.S. Pat. No. 6,793,529 issued Sep. 21, 2004 to Buenz discloses a positive stop for threaded surfaces between the coupling nut and connector body located at the position along the threads at which a specific desired clamping force is applied upon the leading edge of the outer conductor of the attached cable, eliminating the need for torque wrenches and greatly simplifying connector assembly.

Competition in the coaxial cable connector market has focused attention on minimization of overall costs, including materials costs, training requirements for installation personnel, reduction of dedicated installation tooling and the total number of required installation steps and/or operations.

Therefore, it is an object of the invention to provide a connector that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
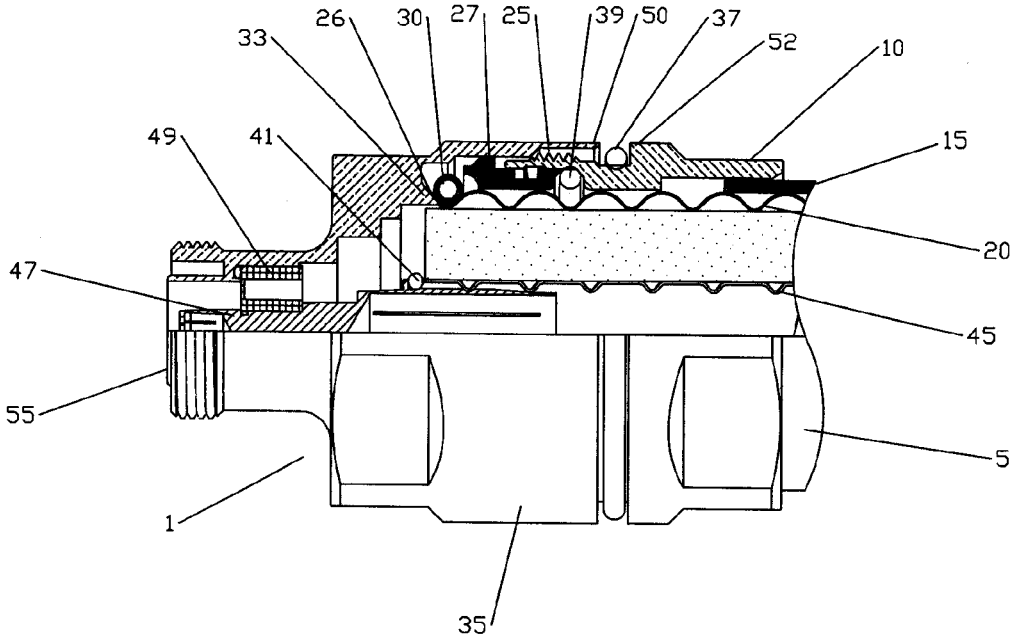
Prior Art Fig. 1
FIG. 1 is a partial cut-away side view of a coaxial connector according to one prior art embodiment, installed upon a coaxial cable, prior to final tightening of the coupling nut.
Figure 2:
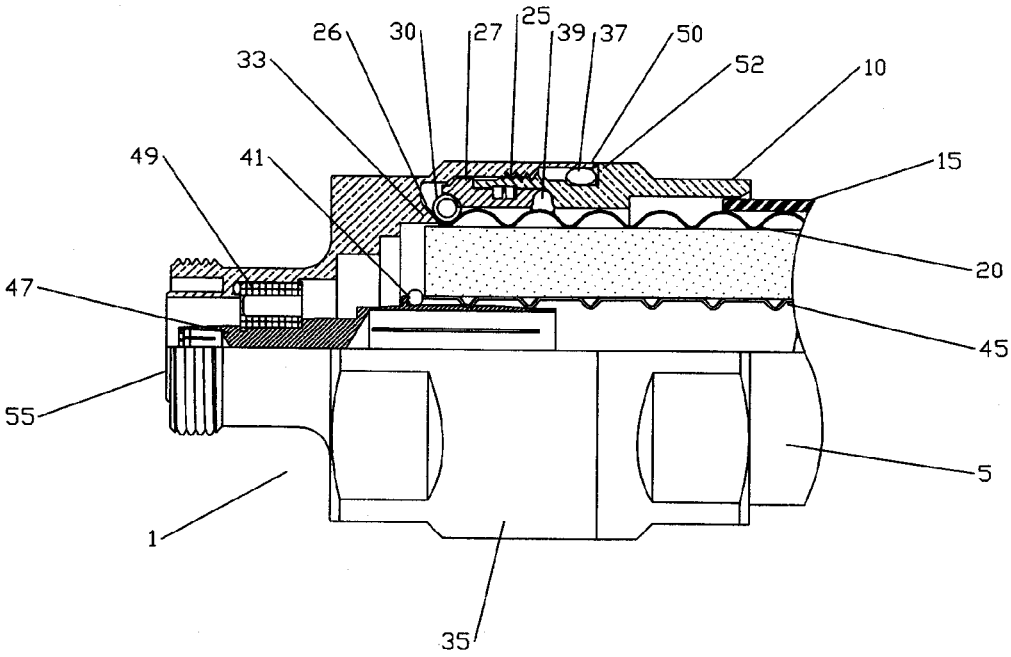
Prior Art Fig. 2
FIG. 2 is a partial cut-away side view of the coaxial connector of FIG. 1, with the coupling nut fully tightened, seated against the positive stop.
Figure 3:
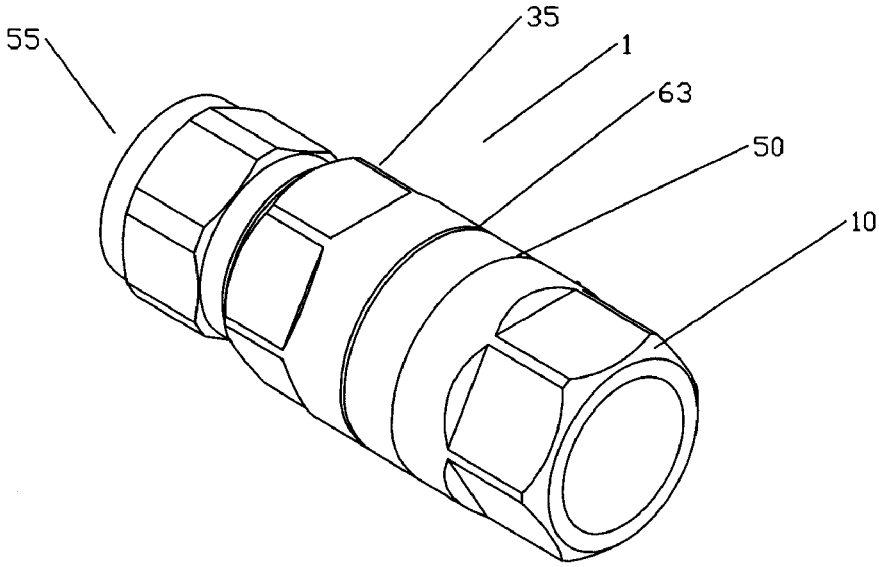
FIG. 3 is a schematic isometric external view of a first exemplary embodiment of the invention.
Figure 4:
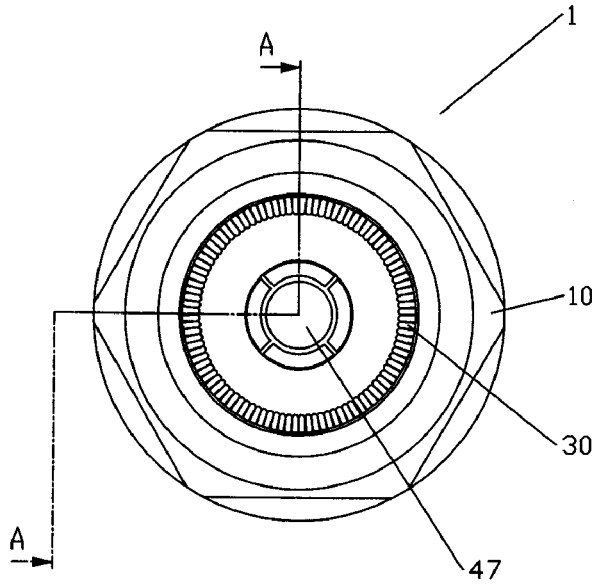
FIG. 4 is a cable end external view of the exemplary embodiment of FIG. 3.
Figure 5:
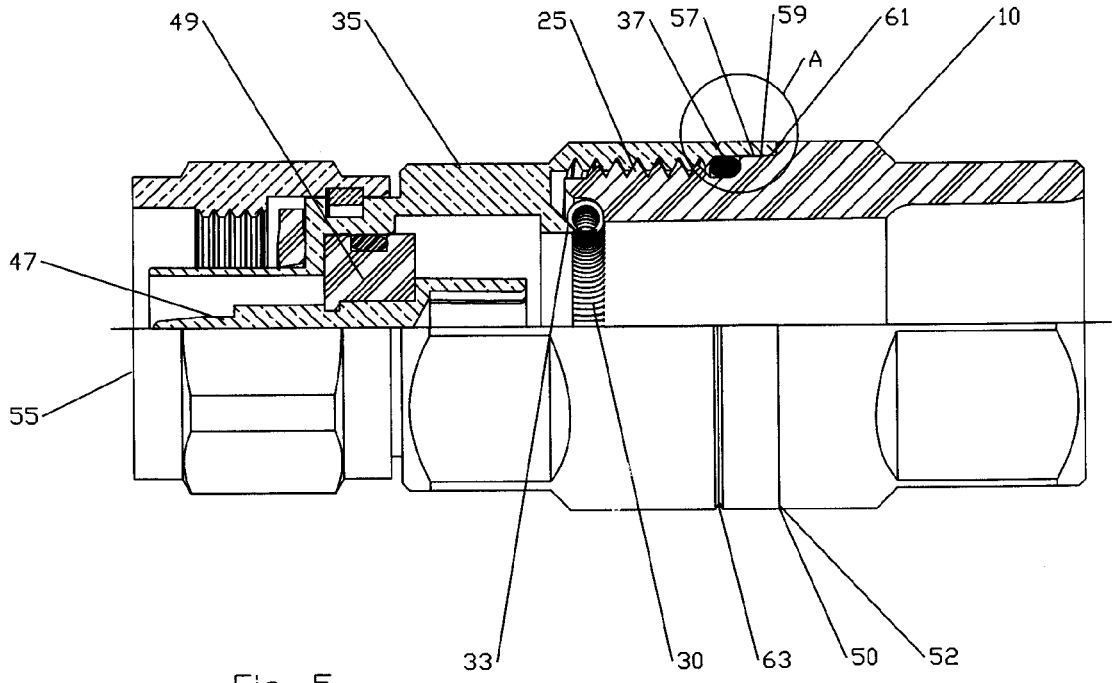
FIG. 5 is a side partial cutaway view along line A-A of FIG. 4.
Figure 6:
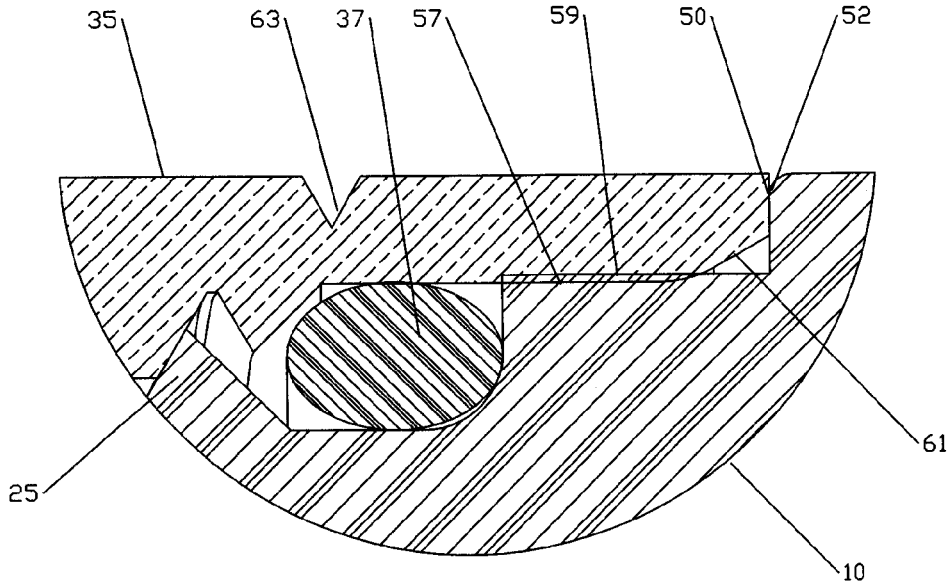
FIG. 6 is a close-up view of area A of FIG. 5.

As shown in FIGS. 1 and 2, a connector 1 according to U.S. Pat. No. 6,793,529 for use with a coaxial cable 5 has a coupling nut 10 adapted to fit over an end portion of the cable 5. A sheath 15 of the cable 5 is removed from the end of the cable 5 to expose the outer conductor 20. Threads 25 between the coupling nut 10 and the connector body 35 operate to drive a thrust collar 27 into a clamp element, here a circular coil spring 30 to clamp a leading edge 26 of the outer conductor 20 between the circular coil spring 30 and an annular wedge surface 33 of the connector body 35, to secure the connector 1 to the cable 5. The clamping action creates a compression force that is distributed evenly around the annular wedge surface 33 to create a uniform electrical and mechanical interconnection between the connector body 35 and the outer conductor 20.

The connector 1 may be supplied with environmental seals to prevent fouling and/or moisture infiltration into the connector 1 and/or coaxial cable 5. A stop o-ring 37 seals between the outer radius of the coupling nut 10 and the connector body 35; an outer conductor o-ring 39 seals between the coupling nut 10 and the outer conductor 20. Further, an inner conductor o-ring 41 seals between the inner conductor 45 and an inner contact 47 coaxially located within the connector 1 by an insulator 49.

Over-tightening of the coupling nut 10 onto the connector body 35, which may generate compression and/or shearing forces at damaging levels, is prevented by a surface-to-surface positive stop contact, for example, between an end 50 of the connector body 35 and a shoulder 52 of the coupling nut 10. One skilled in the art will recognize that other variations of the positive stop are possible: for example shoulder to shoulder and reversal of the end to stop, etc., with the limitation that when reached, the positive stop prevents further threading between the connector body 35 and the coupling nut 10. The specific location upon the connector 1 of the positive stop is adapted to a position where the coupling nut 10 is threaded to the connector body 35 to clamp the leading edge 26 of the outer conductor 15 at a desired maximum compression force level. The circular coil spring 30 may be configured to have an acceptable range of deformation prior to collapse to accommodate manufacturing tolerances of the associated connector 1 components and an expected thickness range of the outer conductor leading edge 26.

Alternative clamp elements may be applied. For example, U.S. Pat. No. 5,795,188 discloses embodiments replacing the circular coil spring 30 with a clamping ring having a plurality of beads or wedge segments. Further alternatives include a thrust collar or separate ring with a plurality of spring fingers capable of bending to allow initial placement over the leading edge 26 but which then either spring down or are forced down by either the coupling nut 10 or connector body 35 to allow the fingers to be compressed against the back side of the leading edge 26. One skilled in the art will appreciate that any clamp element configured to seat against the back side of the leading edge 26 may be applied, the clamp element retaining the leading edge 26 against the annular wedge surface 27 of connector body 30 as the coupling nut 10 is tightened.

Preferably, the selected clamp element has a limited deformation characteristic short of a collapse and/or crush force level to allow for an increased range of associated component manufacturing tolerances. The limited deformation characteristic may be varied to adapt for observed manufacturing tolerances, for example, by varying the selected material, the configuration of the compression arrangement and/or the thickness of the selected material. The selected limited deformation characteristic may be adapted to provide a desired range of additional compression "slack" before the positive stop is reached, allowing use of overall manufacturing cost saving decreased precision in the manufacturing process but still ensuring that each connector assembly will reach the desired compression force when the positive stop is reached, even if the components of an individual connector each happen to be on the short side of the allowable manufacturing tolerance. The selected clamp element, here the circular coil spring 30, may be adapted to have the desired limited deformation characteristic by selecting a material, such as steel, and a desired material thickness wherein the circular coil spring 30 will partially deform over a desired compression force range before either collapsing or transmitting a damaging out of range compression force to the leading edge 26 of the outer conductor 20.

In further embodiments, the overlap between the coupling nut 10 and the connector body 35 may be reversed. That is, rather than the connector body overlapping the coupling nut 10 as shown in FIG. 1, the relative positions of the components may be reversed, for example as shown in U.S. Pat. No. 5,795,188. The compression force generation between the components remains the same in either configuration.

In use, the cable 5 end is prepared and the coupling nut 10 placed over the cable end along with any applicable outer conductor o-ring 39 and thrust collar 27. The circular coil spring 31 or other clamp element is then stretched over the leading edge 26 into position behind the leading edge 26. If used, the stop o-ring 39 is placed upon the coupling nut 10 proximate the shoulder 52. The connector body 35 is then located so that the inner contact 47 engages the inner conductor 45 and the annular wedge surface 33 is pressed against the front side of the leading edge 26. The coupling nut 10 is then moved toward the connector body 30 and threaded into the threads 25 as shown in FIG. 1. The coupling nut 10 is threaded until the end 50 of the connector body 30 reaches the positive stop at the shoulder 52 of the coupling nut 10 as shown in FIG. 2. Reaching the positive stop signifies to the installation personnel that the desired compression force has been reached without requiring use of a torque wrench and prevents further tightening of the coupling nut 10 which would increase the compression force beyond the desired maximum level.

One skilled in the art will appreciate that the connector 1 may be adapted to mate with the dimensions and configuration of a specific coaxial cable 5, for example a coaxial cable 5 with annular or helical corrugations in the inner and/or outer conductors 47, 20. To mate with a circular coil spring 30 or the like adapted for use with outer conductor(s) 20 having helical corrugations, the thrust collar 27 may be formed with a step located at a point where the circular coil spring 30 bridges across the corrugations. Further, the connector end 55 of the connector 1 may be adapted to mate according to male and/or female embodiments of a proprietary or standardized connector interface, such as BNC, Type-N, SMA or DIN.

The inventor(s) have analyzed the long term performance of connectors configured with a positive stop according to U.S. Pat. No. 6,793,529. The friction between smooth coplanar surfaces of the positive stop threaded connection, when installed in environments with extreme levels of vibration, temperature variation and/or moisture penetration, provides less than desired resistance to undesired loosening of the threaded connection, especially where each of the surfaces are metallic. Also, the metal coupling nut adds a significant weight, materials and manufacturing cost to the connector.

Also, the inventor's analysis of previous attempts to apply polymeric materials to clamp nuts has revealed that polymeric material typically has a creep characteristic that further reduces the long-term retention characteristic of threaded interconnections.

Connectors according to the invention incorporate a thread locking feature and optionally use a polymeric material for the coupling nut, instead of metal.

As shown in FIGS. 3-6, a connector according to a first exemplary embodiment of the invention has a thread lock created by an interference fit between the connector body 35 and the coupling nut 10. A body locking surface 57 is located on an inner diameter surface of a cable end of the connector body 35. A corresponding coupling nut locking surface 59 is formed on an outer diameter area of the coupling nut 10, preferably between the shoulder 52 and the threads 25. To form an interference fit between the body locking surface 57 and the coupling nut locking surface 59, the inner diameter of the body locking surface 57 is formed smaller than an outer diameter of the coupling nut locking surface 59. Thereby, as the coupling nut 10 is threaded onto the connector body 35 an interference fit occurs between the body locking surface 57 and the corresponding coupling nut locking surface 59.

The degree of interference fit, that is, the magnitude of mismatch between the opposing locking surface dimensions, may be selected to create a resistance to threading that is not so great that it causes undue effort to thread the elements together up to the positive stop, but alternatively once at the positive stop secures the assembly from undesired unthreading. To assist with the alignment and initial mating of the interference fit between the body locking surface 57 and the coupling nut locking surface 59, an angled guide edge 61 may be applied to one or both of the respective locking surfaces. Further, an annular deflection groove 63 may be applied to the connector body 35 exterior surface at a longitudinal position corresponding to the position of the threads 25. The deflection groove 63 provides a flexure point for the connector body 35 enabling a slight stress relief as the interference fit between the respective locking surfaces is made, until the coupling nut 10 and connector body 35 contact one another at the positive stop.

The coupling nut 10 is preferably formed from a polymeric material such as polybutylene terephthalate (PBT) plastic resin. The PBT or other selected polymeric material may be injection molded and/or machined. Carbon black or the like may be added to the PBT or other selected polymeric material to improve a UV radiation resistance characteristic of the polymeric material. The connector body 35 is preferably formed from a metallic material having suitable strength and conductivity characteristics, such as coated or uncoated brass or a copper alloy.

A slight elasticity characteristic of the polymeric material may aid in permitting the initial threading that engages the interference fit and also then aids in retention of the interference fit once threading is complete, as the polymeric material returns to a static position, sealing securely at the interference fit.

In the present embodiment, a polymeric coupling nut 10 is demonstrated acting directly upon the clamp element, here demonstrated as a circular coil spring 30. One skilled in the art will appreciate other clamp elements and/or additional elements such as a thrust collar 27 may be applied.

In further embodiments, textures, corrugations, ribs, protrusions or the like may be applied to the locking surfaces to provide a positive interlock and/or higher levels of retention/resistance to unthreading. For example, the thread lock may be a plurality of interlocking corrugations and/or ramp features which allow threading in a direction across the ramp faces but which present shoulders or other stops in the direction of unthreading. The thread lock may be applied to create a connector embodiment that is not removable without destroying the connector, once secured upon the coaxial cable 5.

Figure 7:
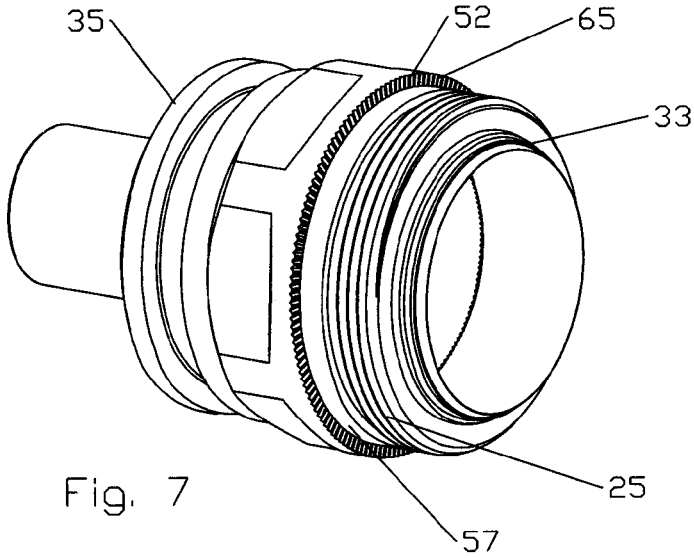
FIG. 7 is a schematic isometric view of a connector body of a second exemplary embodiment.
Figure 8:
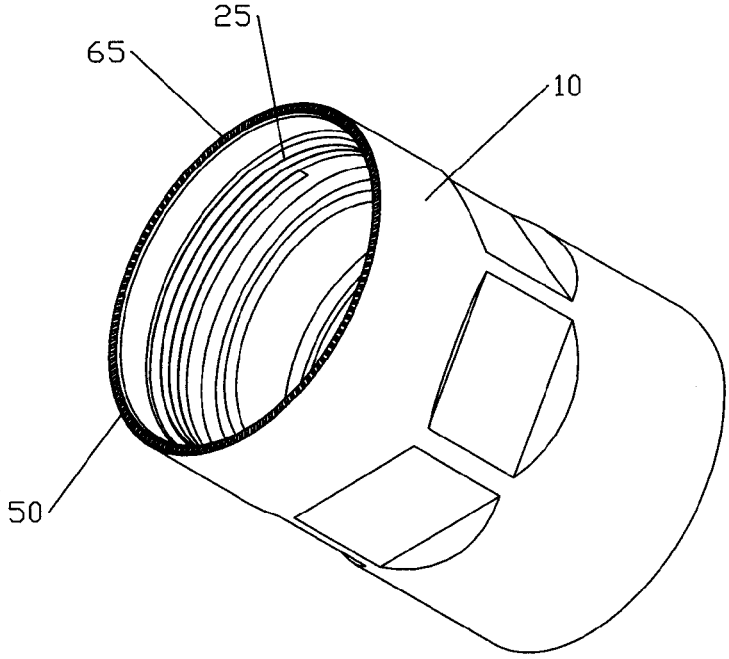
FIG. 8 is a schematic isometric view of a clamp nut of the second exemplary embodiment.
Figure 9:
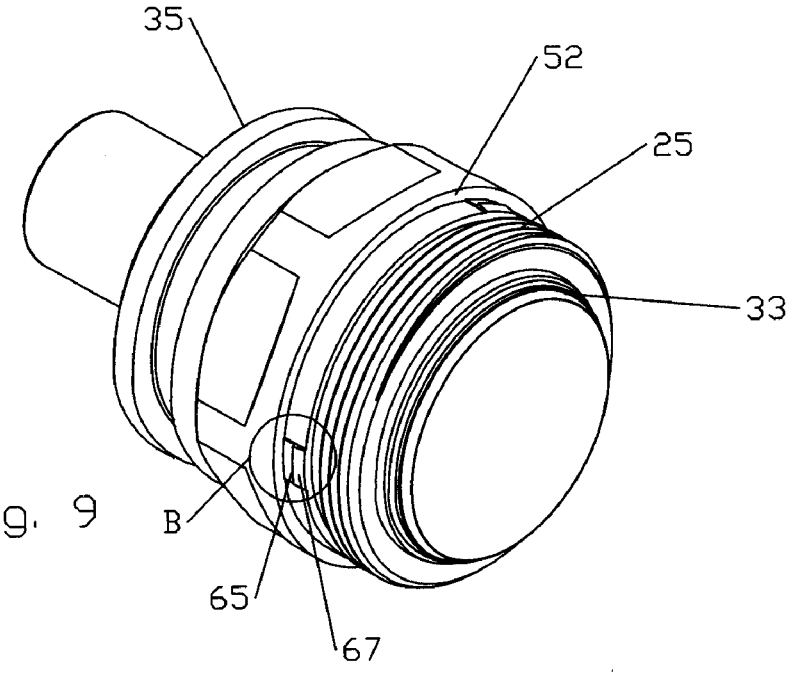
FIG. 9 is a schematic isometric view of a connector body of a third exemplary embodiment.
Figure 10:
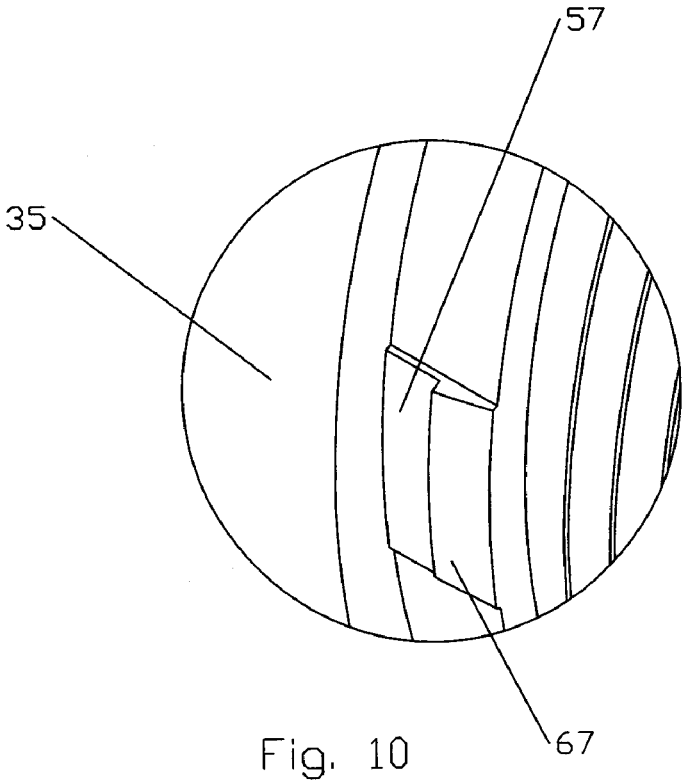
FIG. 10 is a close-up view of area B of FIG. 9.
Figure 11:
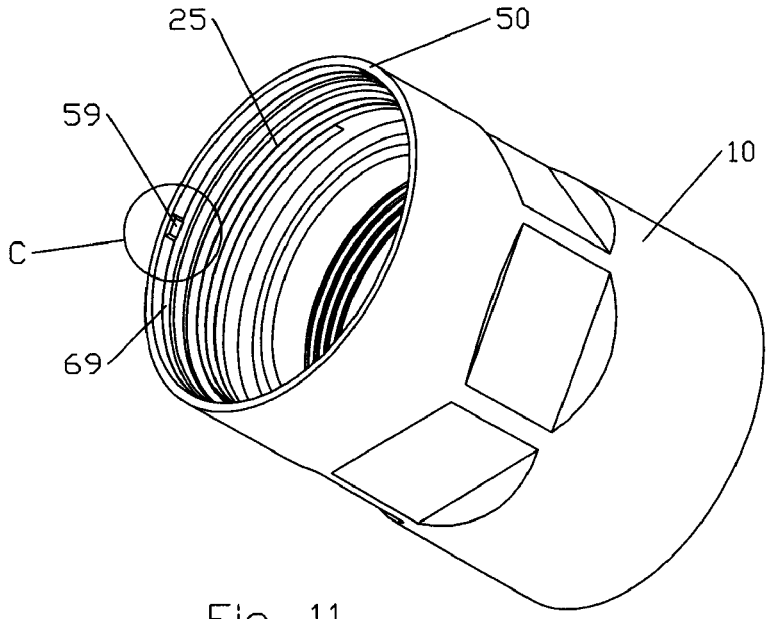
FIG. 11 is a schematic isometric view of a clamp nut of the third exemplary embodiment.
Figure 12:
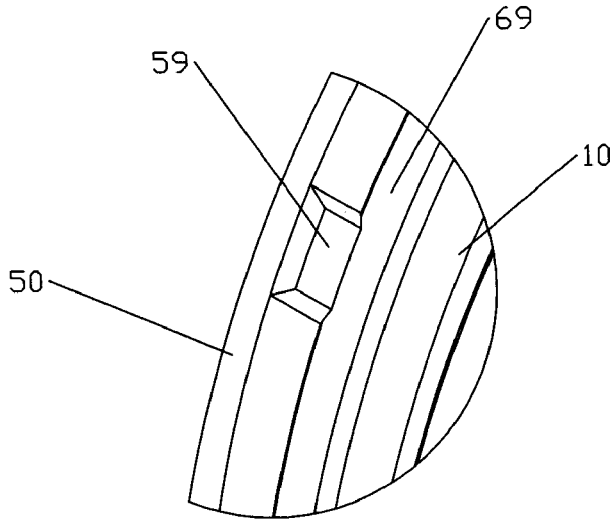
FIG. 12 is a close-up view of area C of FIG. 11.
Figure 13:
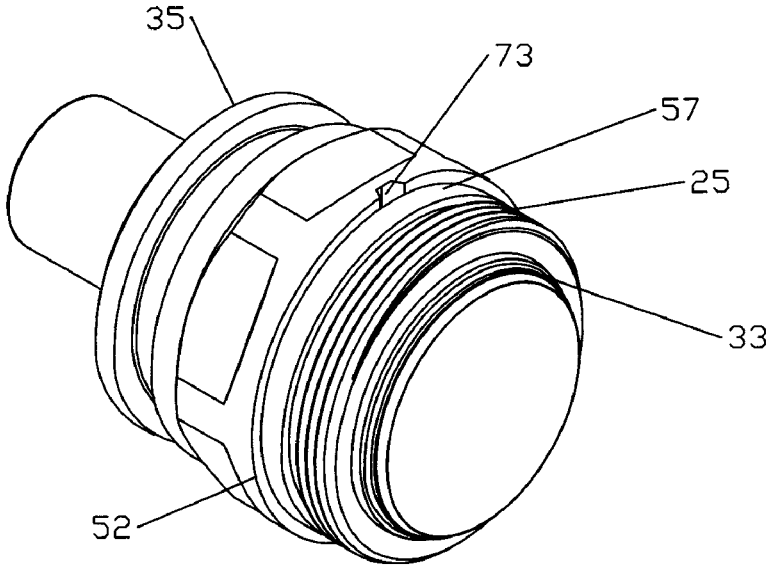
FIG. 13 is a schematic isometric view of a connector body of a fourth exemplary embodiment.
Figure 14:
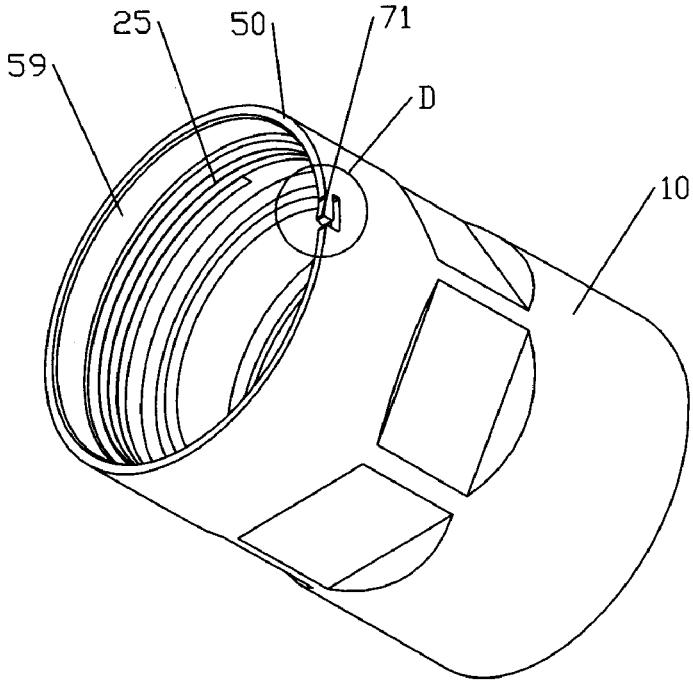
FIG. 14 is a schematic isometric view of a clamp nut of the fourth exemplary embodiment.
Figure 15:
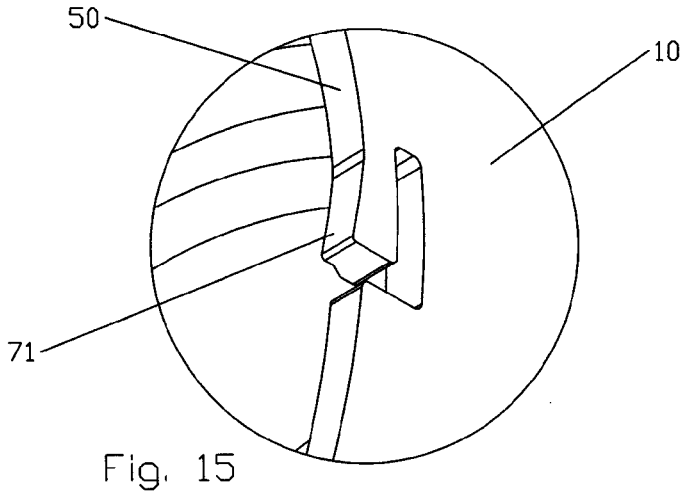
FIG. 15 is a close-up view of area D of FIG. 14.

As described herein above, the arrangement of the overlapping portions containing the threads 25 between the coupling nut 10 and the connector body 35 may be exchanged. A second exemplary embodiment, as shown in FIGS. 7 and 8, demonstrates a threaded interconnection between the coupling nut 10 and connector body 35 in which the coupling nut 10 overlaps the connector body 35. Further, the thread lock is demonstrated as a friction surface formed as corrugation(s) 65 applied to the surfaces of the positive stop contact between the end 50, now of the clamp nut 10, and the shoulder 52, now of the connector body 35. One skilled in the art will recognize that once interlocked with each other, the corrugation(s) 65, alone, provide a significant resistance to unthreading. Depending upon the degree of resistance to unthreading that is desired, the corrugation(s) 65 may be applied with or without also configuring an additional thread lock in the form of, for example, an interference fit between the body locking surface 57 and the coupling nut locking surface 59, as described herein above.

As demonstrated in FIGS. 9-12, in a third exemplary embodiment the thread interlock is a radial ramp protrusion 67 of the connector body 35 that interlocks with an inner diameter ramp groove 69 of the clamp nut 10 as the threading between the clamp nut 10 and connector body 35 reaches the positive stop. Again, depending upon the degree of positive interlock resistance to unthreading that is desired, the ramp protrusion 67 to ramp groove 69 thread interlock may be applied with or without also configuring an additional thread interlock such as an interference fit between the body locking surface 57 and the clamp nut locking surface 59. The interference fit is demonstrated in the present embodiment with a contact area that is a plurality of arc segment(s) that are less than the entire circumference of the clamp nut 10 and/or connector body 35. The length of the arc segments selected for the interference fit surfaces may be used to configure the resistance to threading presented by the interference fit surfaces and also the degree of thread lock function obtained therefrom.

A fourth exemplary embodiment, as shown in FIGS. 13-17, demonstrates a releasable thread lock that enables disassembly of the connector 1 without damage to the thread lock. One or more deflectable tab(s) 71 are positioned to engage and interlock with respective socket(s) 73 against rotation in an unthreading direction as the coupling nut 10 and connector body 35 are threaded together along the corresponding thread(s) 25 to the positive stop.

Figure 16:
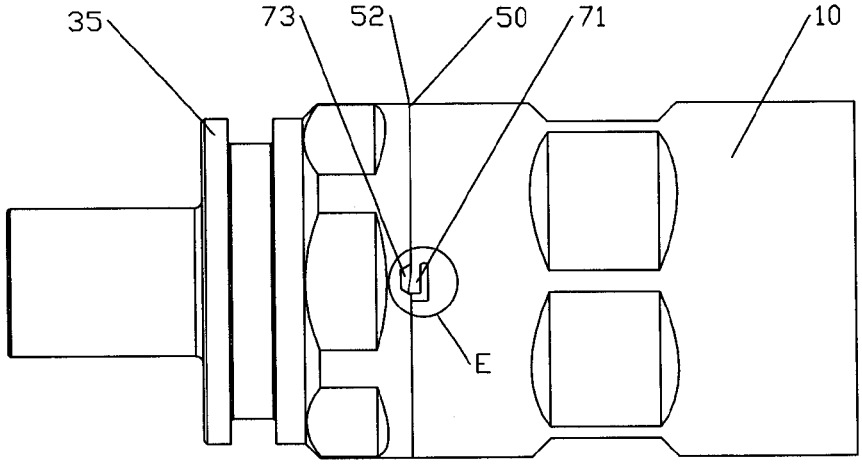
FIG. 16 is a schematic side view of a connector body with attached clamp nut of the fourth exemplary embodiment.
Figure 17:
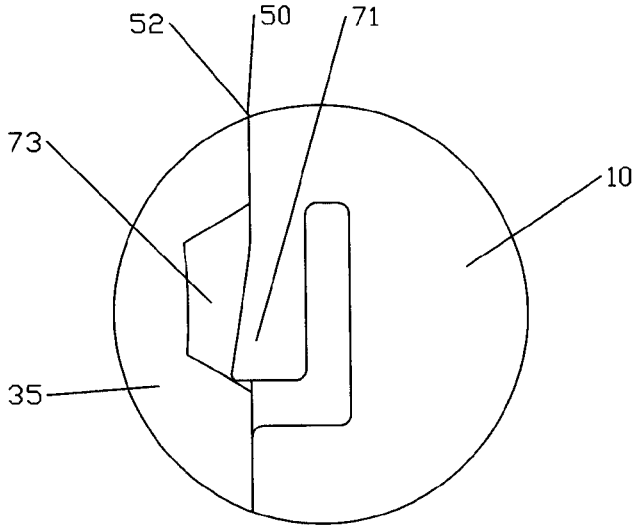
FIG. 17 is a close-up view of area E of FIG. 16.

The interlock between the deflectable tab(s) 71 and socket(s) 73, if configured to be on the exterior surface of the connector, for example as best shown in FIGS. 16 and 17, provides a visual indicia to the assembler that the positive stop has been reached. Alternatively, visual indicia such as alignment marks or the like may be applied the connector exterior to indicate the rotational positions between the connector body 35 and clamp nut 10 that indicate that the positive stop is being approached and/or has been reached.

To disassemble the connector 1 for inspection and/or reuse, the deflectable tab 71 may be manually deflected away from engagement with the socket 73 to enable unthreading of the coupling nut 10 from the connector body 35.

One skilled in the art will appreciate that the addition of thread interlock(s) according to the invention to a coaxial connector with a positive stop configuration significantly improves the connector's resistance to unthreading due to vibration, thermal expansion and/or tampering. The addition of thread interlock(s) also enables the clamp nut 10 to be formed with cost efficient and light weight polymeric materials that may otherwise exhibit an unacceptable threaded connection stability due to a polymeric material creep characteristic.

The various thread lock embodiments of the invention may also be applied to connector configurations that do not include a positive stop configuration and also to threaded connections other than between the connector body and the clamp nut, such as the coupling nut of a connector interface.

Table of Parts

| | |
|---|---|
| 1 | connector |
| 5 | coaxial cable |
| 10 | clamp nut |
| 15 | sheath |

-continued

| Table of Parts | |
|---|---|
| 20 | outer conductor |
| 25 | threads |
| 26 | leading edge |
| 27 | thrust collar |
| 30 | circular coil spring |
| 33 | annular wedge surface |
| 35 | connector body |
| 37 | stop o-ring |
| 39 | outer-conductor o-ring |
| 41 | inner-conductor o-ring |
| 45 | inner conductor |
| 47 | inner contact |
| 49 | insulator |
| 50 | end |
| 52 | shoulder |
| 55 | end |
| 57 | body locking surface |
| 59 | clamp nut locking surface |
| 61 | guide edge |
| 63 | deflection groove |
| 65 | corrugation(s) |
| 67 | ramp protrusion |
| 69 | ramp groove |
| 71 | deflectable tab |
| 73 | socket |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A coaxial connector for use with a coaxial cable having an outer conductor, comprising:

a clamp nut dimensioned to fit over the outer conductor, the clamp nut having threads that mate with corresponding threads on a connector body;

a clamp element between the clamp nut and a leading edge of the outer conductor;

the connector body having an annular wedge surface dimensioned to mate with the leading edge of the outer conductor;

the threads drawing the clamp nut towards the connector body, driving the clamp element to exert a compression force that urges the leading edge into contact with the annular wedge surface;

a surface to surface positive stop between the clamp nut and the connector body limiting the compression force to a predetermined maximum by preventing further movement of the clamp nut towards the connector body; and a thread lock engaged as the positive stop is reached; the thread lock inhibiting unthreading of the clamp nut from the connector body.

2. The coaxial connector of claim 1, wherein the thread lock comprises an interference fit between a body locking surface of the connector body and a clamp nut locking surface of the clamp nut.

3. The coaxial connector of claim 2, wherein a contact area of the interference fit is along at least one arc surface segment of at least one of the connector body locking surface and the clamp nut locking surface that is less than an entire circumference.

4. The coaxial connector of claim 2, wherein the body locking surface is an inner diameter of the connector body and the clamp nut locking surface is an outer diameter surface of the clamp nut.

5. The coaxial connector of claim 2, wherein the body locking surface is an outer diameter of the connector body and the clamp nut locking surface is an inner diameter surface of the clamp nut.

6. The coaxial connector of claim 2, further including an angled guide edge on the body locking surface.

7. The coaxial connector of claim 1, wherein the thread lock comprises corrugations between the clamp nut and the connector body at the positive stop.

8. The coaxial connector of claim 7, further including an interference fit between a body locking surface of the connector body and a clamp nut locking surface of the clamp nut.

9. The coaxial connector of claim 1, wherein the thread lock comprises a ramp protrusion of the connector body that interlocks with a ramp groove of the clamp nut.

10. The coaxial connector of claim 9, further including an interference fit between a body locking surface of the connector body and a clamp nut locking surface of the clamp nut.

11. The coaxial connector of claim 1, wherein the thread lock comprises a deflectable tab of the clamp nut that engages a socket of the connector body.

12. The coaxial connector of claim 11, wherein the deflectable tab is manually deflectable from an exterior of the coaxial connector.

13. The coaxial connector of claim 1, wherein the positive stop comprises an end of the connector body that contacts a shoulder of the clamp nut.

14. The coaxial connector of claim 1, wherein the positive stop comprises an end of the clamp nut that contacts a shoulder of the connector body.

15. The coaxial connector of claim 1, further including a visual indicia that indicates when the positive stop has been reached.

16. A method for manufacturing a coaxial connector for use with a coaxial cable having an outer conductor, comprising the steps of:

providing a connector body with an annular wedge surface dimensioned to mate with a leading edge of the outer conductor;

providing a clamp nut dimensioned to fit over the outer conductor, the clamp nut having threads that mate with corresponding threads on the connector body;

positioning a clamp element between the clamp nut and the leading edge of the outer conductor;

the threads configured to draw the clamp nut towards the connector body, driving the clamp element to exert a compression force that urges the leading edge into contact with the annular wedge surface;

the clamp nut and the connector body formed with a surface to surface positive stop between them, limiting the compression force to a predetermined maximum by preventing further movement of the clamp nut towards the connector body; and the clamp nut and the connector body formed with a thread lock engaged as the positive stop is reached; the thread lock inhibiting unthreading of the clamp nut from the connector body.

17. The method of claim 16, wherein the clamp nut is formed from a polymeric material.

18. The method of claim 17, wherein the clamp nut is formed by injection molding.

19. A coaxial connector for use with a coaxial cable having an outer conductor, comprising:

a clamp nut dimensioned to fit over the outer conductor, the clamp nut having threads that mate with corresponding threads on a connector body;

a clamp element between the clamp nut and a leading edge of the outer conductor;

the connector body having an annular wedge surface dimensioned to mate with the leading edge of the outer conductor;

the threads drawing the clamp nut towards the connector body, driving the clamp element to exert a compression force that urges the leading edge into contact with the annular wedge surface;

a surface to surface positive stop between the clamp nut and the connector body limiting the compression force to a predetermined maximum by preventing further movement of the clamp nut towards the connector body;

an interference fit between a body locking surface on an inner diameter of the connector body and a clamp nut locking surface on an outer diameter surface of the clamp nut; and an angled guide edge on the body locking surface;

wherein the interference fit engaged as the positive stop is reached; the interference fit inhibiting unthreading of the clamp nut from the connector body.

20. The coaxial connector of claim 19, wherein the clamp nut is a polymeric material with a limited deformation characteristic.

* * * * *